United States Patent [19]

Ferrarini

[11] 4,334,144

[45] Jun. 8, 1982

[54] CORONA EFFECT SURFACE TREATMENT APPARATUS FOR SHEET

[76] Inventor: Ezio Ferrarini, Via Melotta, 19, Soncino, Cremona, Italy

[21] Appl. No.: 137,931

[22] Filed: Apr. 7, 1980

[51] Int. Cl.[3] ..... H05B 7/18

[52] U.S. Cl. ..... 219/383; 204/165; 204/122; 219/384; 264/22; 250/324; 422/186.2

[58] Field of Search ..... 219/69 E, 383, 384; 264/22, 23, 24, 25, 26, 27; 204/224 M, 176, 165, 164; 250/324, 531, 541, 542

[56] References Cited

U.S. PATENT DOCUMENTS

| | | | |
|---|---|---|---|
| 2,590,173 | 3/1952 | Guyer | 219/383 X |
| 3,294,971 | 12/1966 | Von Der Hei | 250/324 |
| 3,308,045 | 3/1967 | Sullivan | 204/165 |
| 3,309,299 | 3/1967 | Mantell | 204/165 |
| 3,348,022 | 10/1967 | Schirmer | 219/384 |
| 3,755,683 | 8/1973 | Kiikka et al. | 250/542 |
| 3,777,164 | 12/1973 | Osman | 250/531 |
| 3,894,925 | 7/1975 | Inoue | 204/224 M |
| 3,903,426 | 9/1975 | Lowther | 204/176 X |
| 3,996,122 | 12/1976 | Lowther | 204/176 |
| 4,145,386 | 3/1979 | Rosenthal | 264/22 |

FOREIGN PATENT DOCUMENTS

| | | | |
|---|---|---|---|
| 635191 | 11/1963 | Belgium | 219/383 |

*Primary Examiner*—Volodymyr Y. Mayewsky
*Attorney, Agent, or Firm*—Guido Modiano; Albert Josif

[57] ABSTRACT

An apparatus for corona effect surface treatment of sheet materials, comprising a metal electrode and an insulating material coated electrode, between which the materials to be treated are inserted, wherein in the inside of said coated electrode a cooling fluid is caused to flow.

3 Claims, 3 Drawing Figures

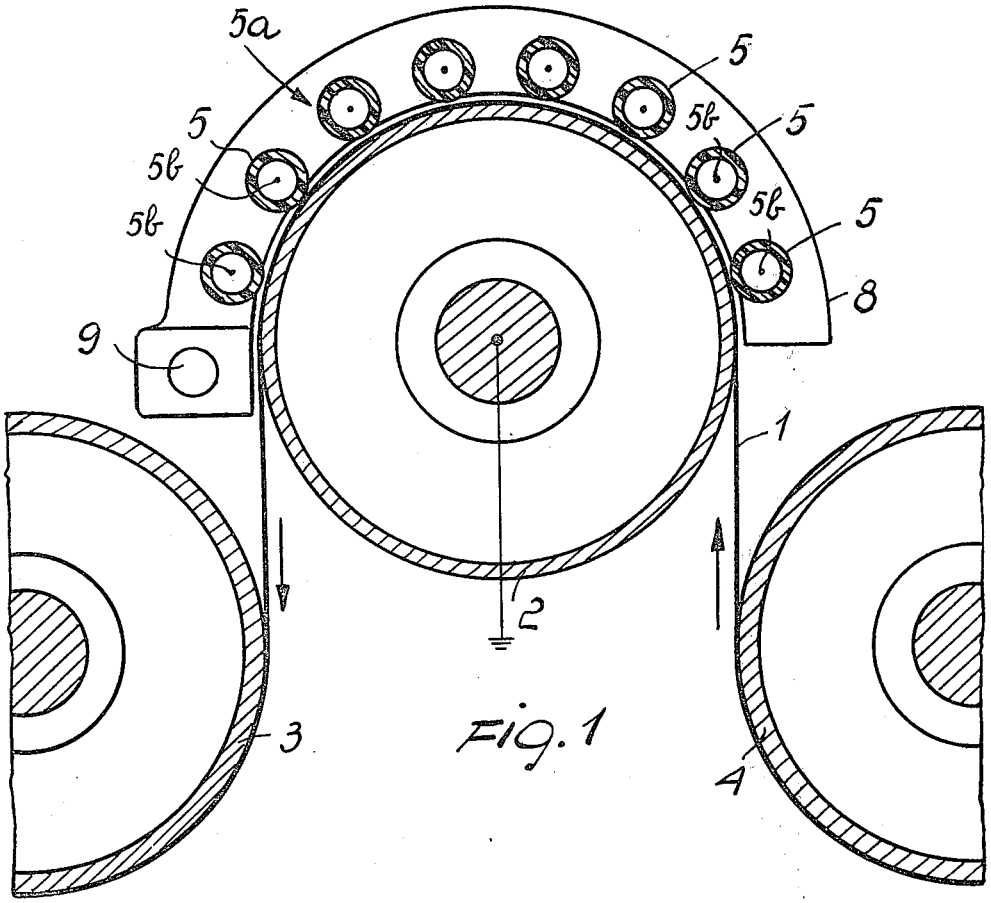
Fig. 1
Fig. 2
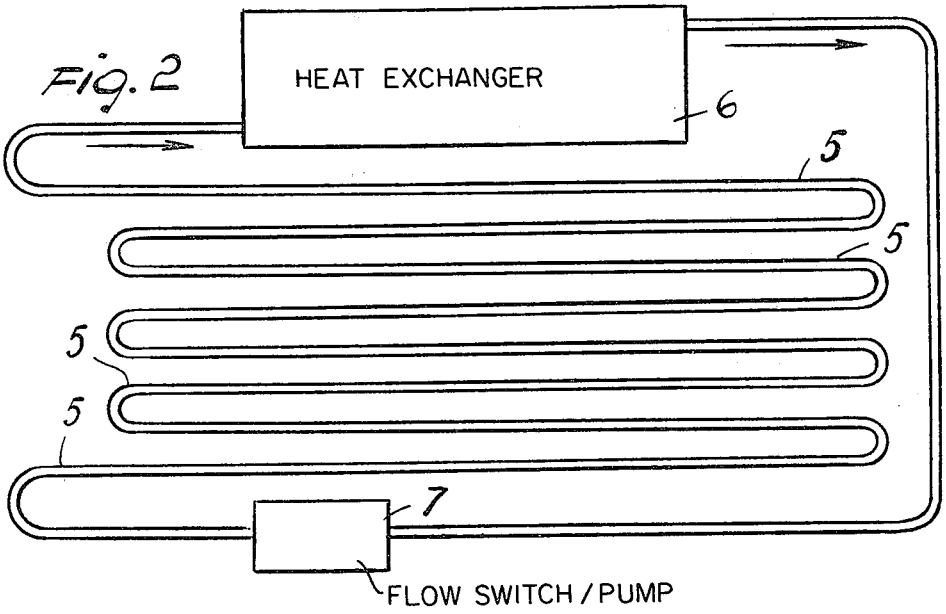

CORONA EFFECT SURFACE TREATMENT APPARATUS FOR SHEET

BACKGROUND OF THE INVENTION

This invention relates to a corona effect surface treatment apparatus for sheet materials.

The corona effect surface treatment of materials is known to consist in causing a corona discharge in the proximity of the surface of the material to be treated in order to achieve surface adhesion characteristics which are useful for anchoring ink, glue, and the like thereto.

The known apparatus intended for corona effect surface treating materials comprise essentially paired parallel electrodes, one of which is coated with an insulating material and the other is of metal; such electrodes are connected to an electric generator operating at a voltage and frequency such as to produce a discharge distributed along the whole length of the electrodes at their mutually facing areas.

The materials to be treated which may be sheets or foils of plastics and other materials are inserted between the two electrodes in the area where the discharge is to occur. Since nearly all of the electric power supplied to the electrodes is converted into heat, the latter is distributed between the surfaces involved by the discharge, thus raising the electrode temperature.

A reduction of the residence time of the material being treated under the discharge, as required for a high production rate or output, requires an increase of the discharge density over the electrodes in order to maintain constant the energy required for the required degree of surface treatment.

This results in an increase of the thermal energy dispensed to the stationary electrodes and a consequent increase of temperature, with an attendant deterioration of the dielectric properties of the insulated electrode.

That difficulty has been obviated in the past in one of two ways:

1. By removing the heat developed on the insulated electrode through the material to be treated, which was caused to slide in intimate contact therewith;
2. By introducing to the inside of the insulated electrode a heat conductive metal bar capable of dissipating it to fins arranged on the heads.

Either methods have applicational limitations when employed in conjunction with high discharge densities; the method (1) owing to the dielectric material of the insulated electrode overheating at the side areas which are not enveloped by the film, the method (2) owing to the relatively small subtraction of heat obtained through conduction by the central bar, and the longitudinal temperature diagram profile of the insulated cylinder, which exhibits a higher temperature in the middle area with attendant higher emissivity and discharge concentration.

SUMMARY OF THE INVENTION

It is an object of this invention to overcome the aforementioned limitations by providing a novel apparatus which is capable of effectively removing heat from the insulated electrode, while at the same time improving the structure of the apparatus.

This object is achieved by an apparatus according to this invention, for corona effect surface treatment of sheet materials, comprising an apparatus for corona effect surface treatment of sheet materials, comprising an elongated metal electrode and at least one insulating material encased electrode coextensive therewith and spaced therefrom to form a gap therebetween through which the materials to be treated are caused to pass and, supporting means for the electrodes, wherein according to the improvement, said encased electrode comprises a tube of insulating material defining a hollow tubular inner space therein, a conductor within said inner space and coextensive with the electrode and in clearing relationship with said tube, a cooling fluid circulating within said tube and a heat exchanger in communication with said tube and means for circulating said cooling fluid therethrough, and electrical connections for connecting said metal and said encased electrodes to the required polarity.

BRIEF DESCRIPTION OF THE DRAWINGS

Further features and advantages will become apparent from the following description of a preferred, though not exclusive, embodiment of the invention, illustrated by way of an example only in the accompanying drawings, where:

FIG. 1 shows schematically, in cross-section, a portion of the apparatus according to the invention;

FIG. 2 shows schematically and separately the development of the insulated discharge electrode.

DESCRIPTION OF THE PREFERRED EMBODIMENTS

Figure 3:
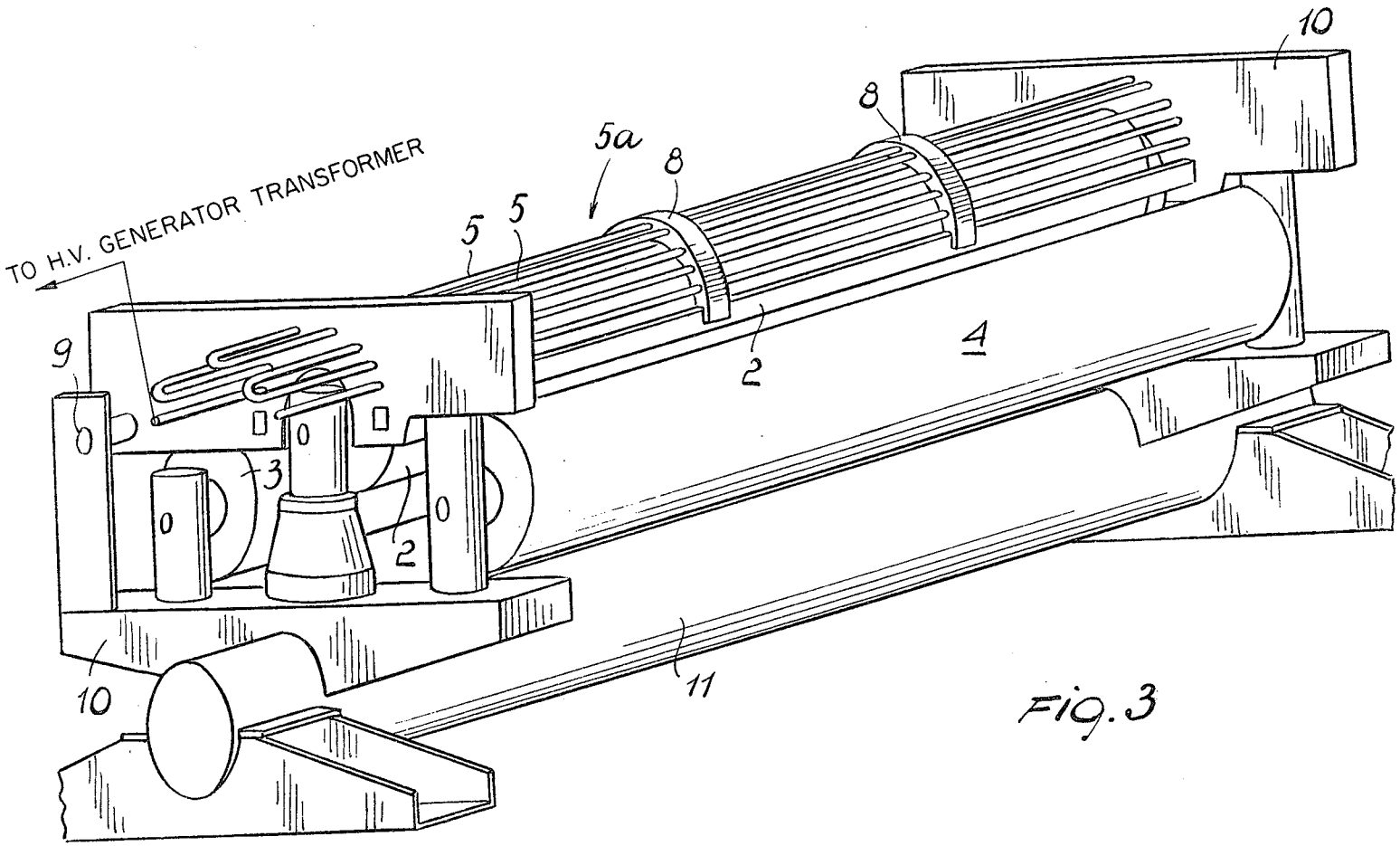
FIG. 3 is a perspective general view showing part of the apparatus.

Making reference to FIG. 1 of the drawings in particular, according to this invention a plastics material or the like, to be surface treated, is fed as shown in FIG. 1 in the form of a continuous web or strip 1 to a system of rollers mounted for idle rotation about their axes and driven by the web 1 itself, which is held under tension by feeding and entraining systems located upstream and downstream of the web or strip 1, and known per se. Thus, the web is positioned at an accurately defined location along an arc of a central roller 2 which acts as a high tension metal electrode, whilst the auxiliary side rollers 3 and 4 define the web angle of winding.

Arranged concentrically to the central roller 2 is a skirt of parallel cylindrical tubes 5, made of a dielectric material and enclosing a cooling fluid flowing therethrough and a connecting pipe, which all constitute the grounded electrode encased in an insulating material. More specifically, the encased electrode 5 comprises a wire 5*b* surrounded by a cooling fluid having a high dielectric constant which is caused to flow and contained in a glass tube. The electric discharge occurs between the surfaces of the dielectric tubes 5, facing the central roller 2, and the exposed surface of the web or strip 1 to be treated.

Preferably the dielectric tubes 5 are made of glass, in particular quarz. As visible from FIG. 2 and 3 the tubes are arranged spaced side by side and consecutively connected at their ends to form a coil of an overall semi-cylindrical configuration.

According to one embodiment the conductive wire 5*b* is made of tungsten or silver and the cooling fluid is water with an antifreeze admixed therein. This embodiment may be suitable when the central roller 2 is grounded and aluminum foil based material is treated to avoid short circuiting.

According to another embodiment instead of wire 5*b* a tubular conductor of copper is placed within the glass tube. In such case the dielectric fluid is oil. The outside diameter of the tubular conductor may be about 10 mm. while the inner diameter of the glass tube is about 11 mm. to allow for dilatation due to temperature changes. The thickness of the glass tube wall is about 4,5 mm. In case of wire conductor 5*b*, the diameter of the wire is 1,2 mm. and the inner diameter of the glass tube is about 6 mm. The voltage used may be of about 25.000 volts and the frequency 10.000 Hz and about 0,5 Amperes.

The heat induced on the dielectric tubes 5, as removed by the cooling fluid, is transferred to the ambient through a heat exchanger 6 (FIG. 2).

The temperature is advantageously maintained below 100° C.

It will be understood from the foregoing that this electrode is an insulating material encased electrode defining a hollow tubular inner space and that the conductor contained therein is in clearing relationship with the inner surface of the tube so that the cooling fluid is in direct contact with the conductor and with the inner surface of the tube over their entire extension.

The cooling fluid flows in a closed circuit and may be either naturally circulated or forced; in this latter case, a flow switch 7 which may incorporate a circulation pump is provided to shut off the operation of the electric generator in the event of an insufficient flow rate occuring. It may be regulated to act when the pressure head is lower than 0,1 atm.

The dielectric tubes 5, as shown in FIG. 3, define a skirting member 5*a* which partially surrounds the central roller 2 enclosing it and is held in position by a frame of an insulating material which is capable of resisting the corona effect, said position being defined in practice by arch members 8. Such a structure is hinged to and tiltable about an end pin 9 to allow, in its open position, for the operations relative to the introduction of the web or strip.

Supporting brackets frame 10 for the three rollers 2,3,4 are also provided which is rigid with a pivotable carrier shaft 11, to permit an optimum orientation of the apparatus with respect to the feeding or entry angle and to the angle of recovery of the web or strip 1, as dictated by the equipment existing upstream and downstream of the web.

So far the structure and operation of the apparatus according to the invention has been described, which by virtue of its characteristic features fully achieves its object, namely an effective subtraction of heat from the insulated discharge electrode, or in other words, from the dielectric tubes 5, and improving its structural features.

In the heretofor disclosed embodiments as cooling fluids water and oil have been indicated. However good results have also been obtained when using air as cooling fluid. Advantageously air may be circulated outside the electrodes.

I claim:

1. An apparatus for corona effect surface treatment of sheet materials, comprising an elongated metal electrode and at least one insulating material encased electrode coextensive therewith and spaced therefrom to form a gap therebetween through which the materials to be treated are caused to pass and, supporting means for the electrodes, wherein according to the improvement, said encased electrode comprises a tube of insulating material defining a hollow tubular inner space therein, a conductor within said inner space and coextensive with the electrode and in clearing relationship with said tube, a cooling fluid circulating within said tube and a heat exchanger in communication with said tube and means for circulating said cooling fluid therethrough, and electrical connections for connecting said metal and said encased electrodes to the required polarity.

2. An apparatus according to claim 1, wherein said metal electrode is cylindrical in shape, said encased electrodes are arranged spaced side by side and consecutively connected to form a coil extending over a semi-cylindrical configuration to form a semi-cylindrical skirting member partially surrounding said metal electrode, and wherein said supporting means comprise a frame of insulating material for said encased electrode, a support for said frame and for said metal electrode and hinge means between said support and said frame to allow mutual angular displacements thereof, said hinge means having an axis extending parallel to the longitudinal extension of said metal electrode.

3. An apparatus according to claim 2, further comprising auxiliary side rollers for guiding the sheet material to be treated said side rollers being supported by said support, pivot means for said support extending in the longitudinal direction of said metal electrode and allowing angular adjustment of said support.

* * * * *